US012606280B2

(12) United States Patent
Smith et al.

(10) Patent No.: US 12,606,280 B2
(45) **Date of Patent: *Apr. 21, 2026**

(54) DECELERATION OF GYROSCOPIC BOAT ROLL STABILIZER

(71) Applicant: WaveTamer LLC, Greenville, NC (US)

(72) Inventors: Grady F. Smith, Greenville, NC (US); Jon Benavides, Sterling Heights, MI (US)

(73) Assignee: WAVETAMER LLC, Greenville, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/046,873

(22) Filed: Feb. 6, 2025

(65) Prior Publication Data

US 2025/0178700 A1 Jun. 5, 2025

Related U.S. Application Data

(63) Continuation of application No. 18/441,737, filed on Feb. 14, 2024, now Pat. No. 12,227,271.

(60) Provisional application No. 63/537,647, filed on Sep. 11, 2023.

(51) Int. Cl.
*B63B 39/04* (2006.01)

(52) U.S. Cl.
CPC ..... *B63B 39/04* (2013.01); *Y10T 74/12* (2015.01)

(58) Field of Classification Search
CPC ... B63B 39/04; B63B 39/06; B63B 2039/067; B63B 2209/06; G01C 19/32; G01C 19/34; G01C 19/00
See application file for complete search history.

(56) References Cited

U.S. PATENT DOCUMENTS

| | | | |
|---|---|---|---|
| 4,069,669 | A | 1/1978 | Pitkanen |
| 5,717,263 | A | 2/1998 | Cox |
| 5,912,519 | A | 6/1999 | Horner et al. |

(Continued)

FOREIGN PATENT DOCUMENTS

| | | | |
|---|---|---|---|
| CN | 104578595 | A | 4/2015 |
| CN | 204408103 | U | 6/2015 |

(Continued)

*Primary Examiner* — Zakaria Elahmadi
(74) *Attorney, Agent, or Firm* — COATS & BENNETT, PLLC

(57) ABSTRACT

A gyroscopic roll stabilizer includes an enclosure, a flywheel assembly, a bearing, a motor, and a bearing cooling circuit. The enclosure is mounted to a gimbal for rotation about a gimbal axis and configured to maintain a below-ambient pressure. The flywheel assembly includes a flywheel and flywheel shaft. The bearing rotatably mounts the flywheel assembly inside the enclosure for rotation about a flywheel axis. The bearing has an inner race and an outer race. The inner race is affixed to the flywheel shaft, and the outer race is held rotationally fixed relative to the enclosure. The motor is operative to rotate the flywheel assembly. The bearing cooling circuit is configured to transfer heat away from the bearing by recirculating cooling fluid along a closed fluid pathway. The gyroscopic roll stabilizer is configured to transfer heat away from the inner and/or outer race of the bearing to the cooling fluid.

23 Claims, 7 Drawing Sheets

(56) References Cited

U.S. PATENT DOCUMENTS

| | | | | |
|---|---|---|---|---|
| 7,546,782 | B2 * | 6/2009 | Adams | B63B 39/04 310/64 |
| 8,242,649 | B2 | 8/2012 | Fradella | |
| 10,794,699 | B2 | 10/2020 | Miocevich et al. | |
| 11,050,322 | B2 | 6/2021 | Gieras et al. | |
| 11,338,942 | B2 | 5/2022 | Bloomquist | |
| 11,591,052 | B2 | 2/2023 | Sohacki et al. | |
| 11,649,017 | B2 | 5/2023 | Smith et al. | |
| 11,794,863 | B2 | 10/2023 | Gai et al. | |
| 2007/0157749 | A1 * | 7/2007 | Adams | F16C 37/007 74/5.12 |
| 2009/0301373 | A1 * | 12/2009 | Adams | B63B 39/04 114/122 |
| 2014/0124172 | A1 | 5/2014 | Veltri et al. | |
| 2014/0292120 | A1 | 10/2014 | Kalev | |
| 2014/0300224 | A1 | 10/2014 | Kalev | |
| 2015/0318758 | A1 | 11/2015 | Kalev et al. | |
| 2018/0051988 | A1 * | 2/2018 | Miocevich | F16N 13/00 |
| 2019/0367137 | A1 * | 12/2019 | Smith | H02K 7/02 |
| 2019/0367138 | A1 * | 12/2019 | Smith | H02K 5/1732 |
| 2020/0165010 | A1 | 5/2020 | Sun et al. | |
| 2020/0317308 | A1 * | 10/2020 | Peterson | B63B 39/04 |
| 2021/0269127 | A1 * | 9/2021 | Sohacki | F16C 37/007 |
| 2024/0400167 | A1 | 12/2024 | Lappin et al. | |
| 2025/0042519 | A1 | 2/2025 | Lappin et al. | |

FOREIGN PATENT DOCUMENTS

| | | | |
|---|---|---|---|
| CN | 110198092 | A | 9/2019 |
| CN | 112510894 | A | 3/2021 |
| CN | 112531962 | A | 3/2021 |
| CN | 213027712 | U | 4/2021 |
| CN | 114562556 | A | 5/2022 |
| CN | 114448162 | A | 6/2022 |
| DE | 4200824 | A1 | 7/1993 |
| EP | 0707754 | A1 | 4/1996 |
| WO | 9502271 | | 1/1995 |
| WO | 20050040776 | A1 | 2/2005 |
| WO | 2011100796 | A1 | 8/2011 |
| WO | 2019224322 | A1 | 11/2019 |
| WO | 2020199946 | A1 | 10/2020 |
| WO | 2021080437 | A1 | 4/2021 |

* cited by examiner

DECELERATION OF GYROSCOPIC BOAT ROLL STABILIZER

RELATED APPLICATIONS

The present application is a continuation of U.S. patent application Ser. No. 18/441,737, filed Feb. 14, 2024, which claims benefit of U.S. Provisional Application No. 63/537,647, filed Sep. 11, 2023, and claims priority to International Application No. PCT/US2024/045823, filed Sep. 9, 2024, the disclosures of each of which are incorporated herein by reference in their entirety.

TECHNICAL FIELD

The present disclosure relates generally to gyroscopic boat roll stabilizers for reducing the sideways rolling motion of a boat and, more particularly, methods and apparatus for rapidly decelerating a controlled moment gyroscope after power is turned off.

BACKGROUND

The sideways rolling motion of a boat can create safety problems for passengers and crew on boats, as well as cause discomfort to passengers not accustomed to the rolling motion of the boat. A number of technologies currently exist to reduce the sideways rolling motion of a boat. One technology currently in use is active fin stabilization. Stabilizer fins are attached to the hull of the boat beneath the waterline and generate lift to reduce the roll of the boat due to wind or waves. In the case of active fin stabilization, the motion of the boat is sensed and the angle of the fin is controlled based on the motion of the boat to generate a force to counteract the roll. Fin stabilization is most commonly used on large boats and is effective when the boat is underway. Fin stabilization technology is not used frequently in smaller boats and is generally not effective when the boat is at rest. Stabilizer fins also add to the drag of the hull and are susceptible to damage.

Gyroscopic boat stabilization is another technology for roll suppression that is based on the gyroscopic effect. A control moment gyroscope (CMG) is mounted in the boat and generates a torque that can be used to counteract the rolling motion of the boat. The CMG includes a flywheel that spins at a high speed. A controller senses the attitude of the boat and uses the energy stored in the flywheel to "correct" the attitude of the boat by applying a torque to the hull counteracting the rolling motion of the boat. CMGs work not only when a boat is underway, but also when the boat is at rest. CMGs are also typically less expensive than stabilizer fins, do not add to the drag of the hull, and are not exposed to risk of damage from external impacts.

Although, CMGs are gaining in popularity, particularly for smaller fishing boats and yachts, this technology has some limitations. The energy used to counteract the rolling motion of the boat comes from the angular momentum of the flywheel rotating at a high rate of speed. Consequently, heat builds up in the bearings supporting the flywheel and bearing failure can result if the operational temperature of the bearings is exceeded. The flywheel is typically mounted inside an enclosure for safety reasons. In order to obtain the high spin rate, the flywheel is typically contained in a vacuum enclosure, which makes heat dissipation problematic.

Another problem with existing CMGs is the amount of time it takes to decelerate the flywheel from normal operating speed to a full stop after power is turned off. The inertia of the flywheel typically requires 4-6 hours or more to decelerate the flywheel to a full stop after power is turned off. While the flywheel is slowing down, it continues to make a whining noise, which can be disruptive to the enjoyment of the occupants after the boat has arrived at its destination on the water or returned to the docks following a day of boating.

SUMMARY

The present disclosure relates generally to deceleration of a flywheel in a gyroscopic boat roll stabilizer. The gyroscopic stabilizer comprises an enclosure mounted to a gimbal for rotation about a gimbal axis and configured to maintain a below-ambient pressure, a flywheel assembly including a flywheel and flywheel shaft rotatably mounted in the enclosure, and at least one bearing supporting the flywheel assembly in the enclosure. The bearing includes an inner race that rotates with the flywheel shaft and an outer race that is stationary relative to the enclosure. The gyroscopic boat roll stabilizer comprises a motor operative to rotate the flywheel assembly, and a brake configured to decelerate the flywheel assembly from a normal operating speed to a stop in 2.5 hours or less after power to the motor is turned off. A bearing cooling system is provided for dissipating heat from both the inner and outer races of the bearing while the flywheel assembly is decelerating. The bearing cooling system is designed to maintain a temperature differential between the inner and outer races below a threshold to prevent damage to the bearings.

DETAILED DESCRIPTION

Figure 1A:
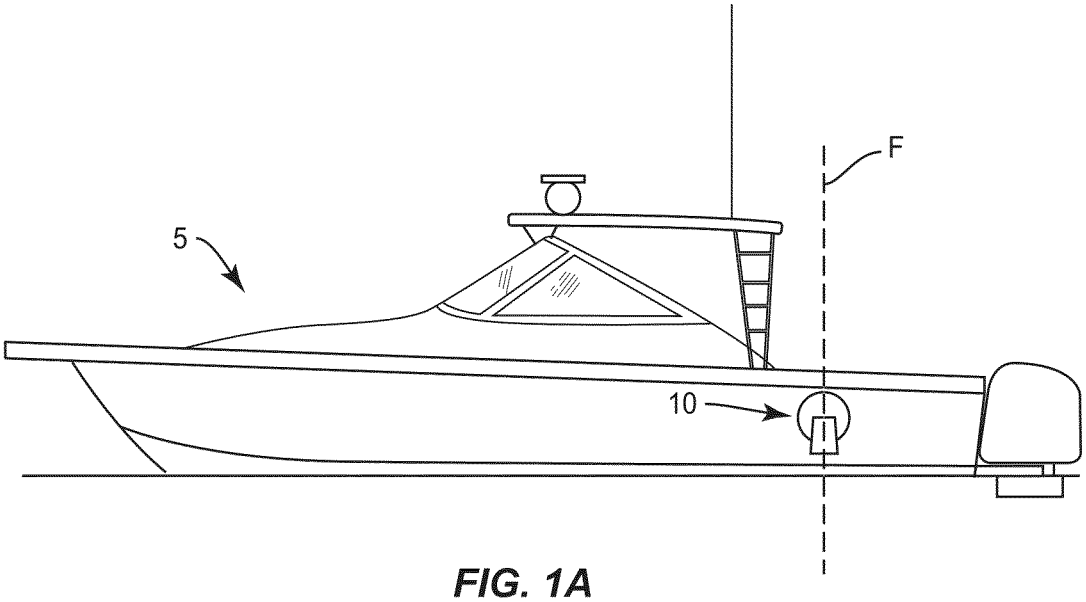
FIGS. 1A and 1B illustrate a boat equipped with a CMG as herein described.
Figure 1B:
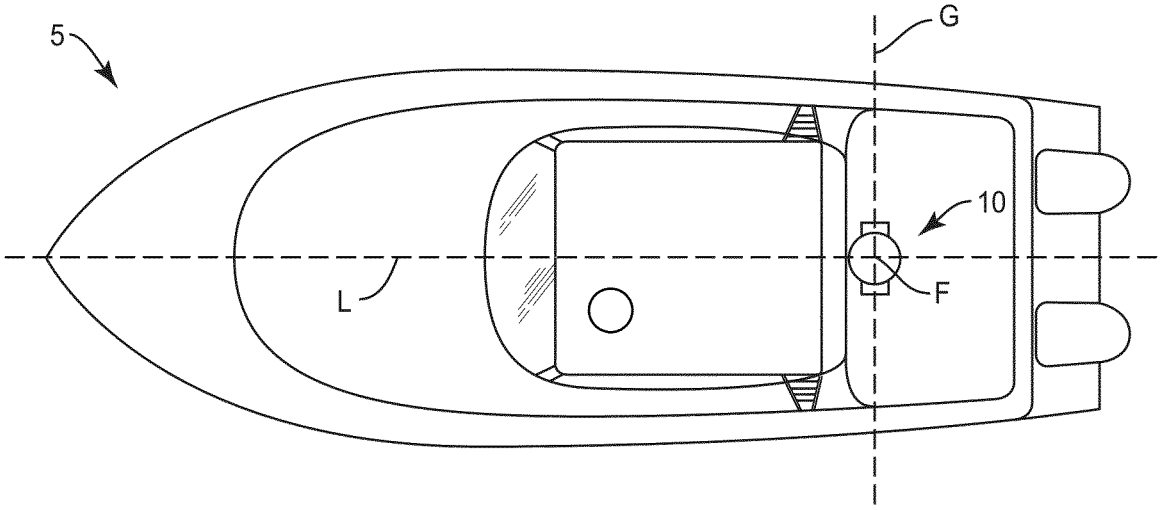

Referring now to the drawings, FIGS. 1A and 1B illustrate a control moment gyroscope (CMG) 10 mounted in a boat 5 for roll stabilization. For convenience, similar reference numbers are used in the following description of the embodiments to indicate similar elements in each of the embodiments.

Figure 2:
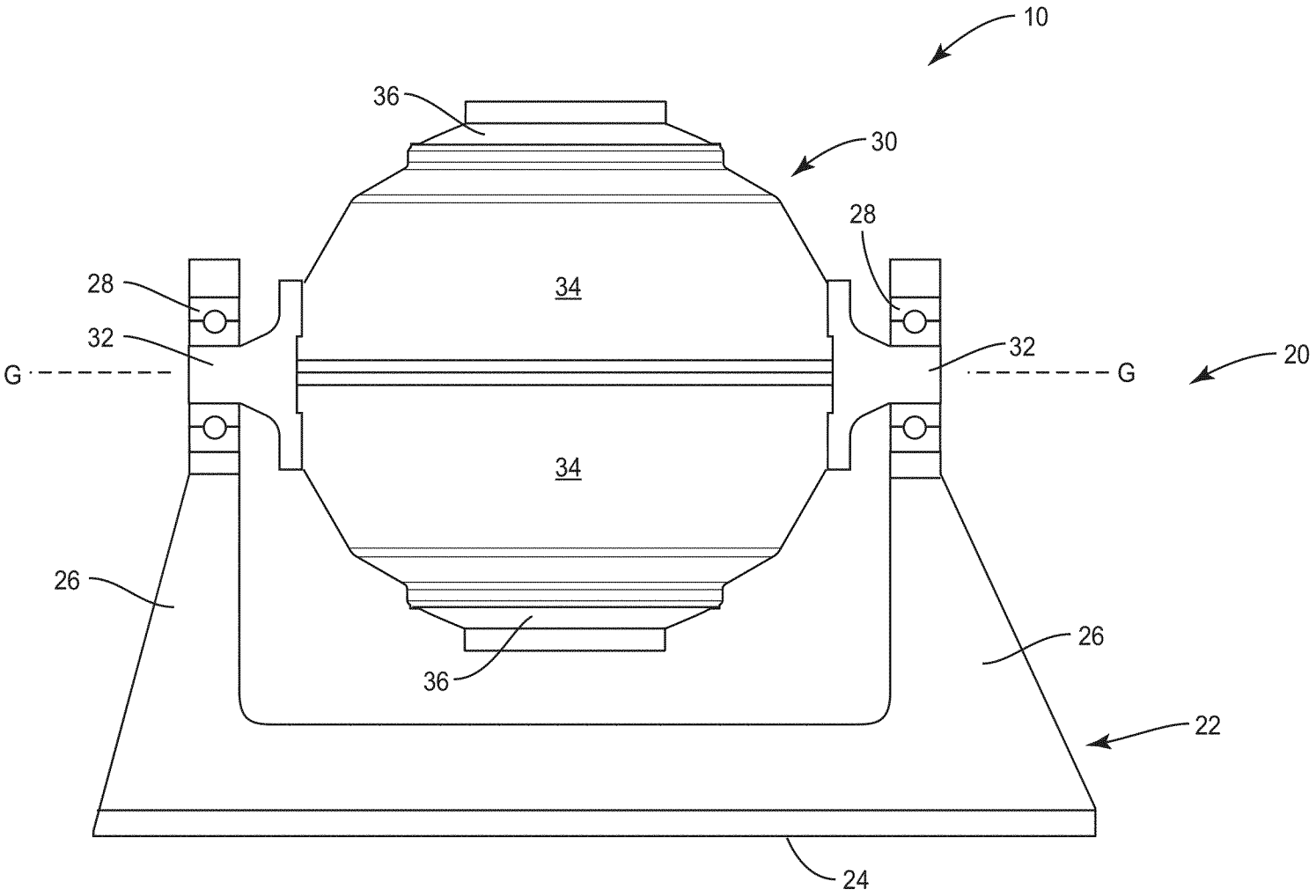
FIG. 2 shows an elevation view of a CMG configured as a boat roll stabilizer according to an embodiment.
Figure 3:
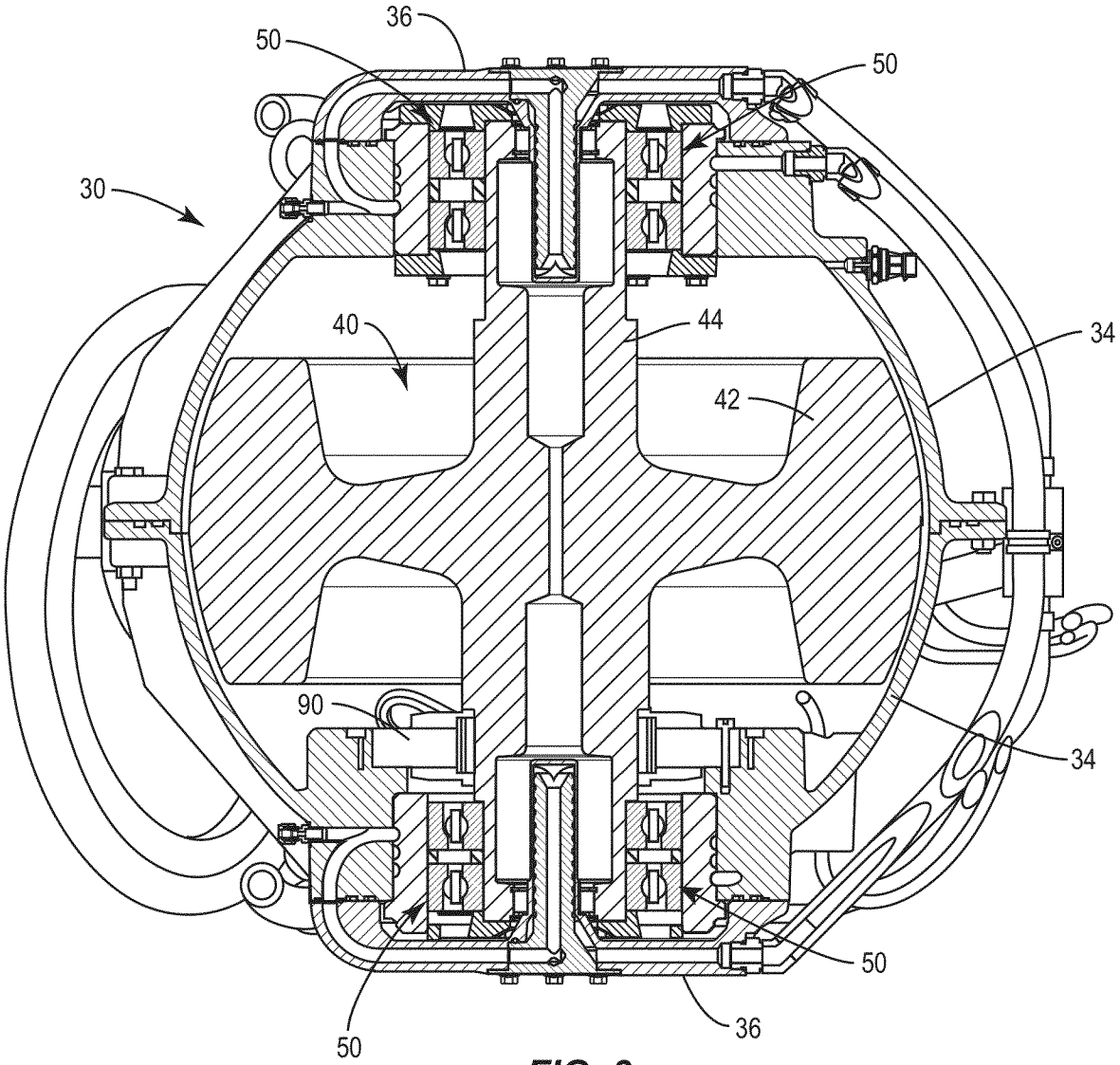
FIG. 3 shows a section view of a CMG according to an embodiment.

Referring now to FIGS. 2 and 3, the main functional elements of the CMG 10 comprise a single-axis gimbal 20, an enclosure 30 mounted to the gimbal 20 for rotation about a gimbal axis G, a flywheel assembly 40 mounted by bearings 50 inside the enclosure 30, a motor 90 to rotate the flywheel assembly 40, and a torque control system 70 (FIG. 5) to control precession of the flywheel assembly 40, a bearing cooling system 100 (FIGS. 7A & 7B) to cool the flywheel bearings 50, and a drive circuit 80 (FIG. 6) to drive the motor 90 during operation. Various designs of the bearing cooling system 100 are disclosed.

The gimbal 20 comprises a support frame 22 that is configured to be securely mounted in the boat 5. Preferably, the gimbal 20 is mounted along a longitudinal axis L of the boat 5 with the gimbal axis G extending transverse to the longitudinal axis L. Conventionally, the gimbal 20 is mounted in the hull of the boat 5, but could be mounted at any location. The support frame 22 of the gimbal 20 comprises a base 24 and two spaced-apart supports 26. A bearing 28 is mounted on each support 26 for rotatably mounting the enclosure 30 to the supports 26. For this purpose, the enclosure 30 includes two gimbal shafts 32 projecting from diametrically opposed sides of the enclosure 30. The gimbal shafts 32 are rotatably journaled in the gimbal bearings 28 to allow the enclosure 30 (and flywheel assembly 40 disposed therein) to rotate or precess about the gimbal axis G in the fore and aft directions.

The enclosure 30 is advantageously generally spherical in form and comprises two main housing sections 34 and two end caps 36. The two main housing sections 34 join along a plane that typically bisects the spherical enclosure 30. The end caps 36 join the main housing sections 34 along respective planes closer to the "poles" of the spherical enclosure 30. All joints in the enclosure 30 are sealed to maintain a below-ambient pressure within the enclosure 30 to reduce aerodynamic drag on the flywheel assembly 40. Typical below-ambient pressures should be in the range of 1-40 torr (133-5333 Pa, 0.02-0.77 psi).

The flywheel assembly 40 conceptually comprises a flywheel 42 and flywheel shaft 44 that is mounted for rotation inside the enclosure 30 of the gimbal 20 so that the axis of rotation F of the flywheel assembly 40 is perpendicular to the gimbal axis G. Thus, when the boat 5 is level such that gimbal axis G is horizontal, the axis of rotation F of the flywheel shaft 44 will be in the vertical direction, typically perpendicular to the deck of the boat. The flywheel 42 and shaft 44 may be formed as a unitary piece or may comprise two separate components. In one exemplary embodiment, the diameter of the flywheel 42 is approximately 20.5 inches; the flywheel assembly 40 has a total weight of about 614 pounds; and the flywheel assembly 40 has a moment of inertia of about 32,273 lbm $in^2$. When rotated at a rate of 9000 rpm, the angular momentum of the flywheel assembly 40 is about 211,225 lbm $ft^2/s$.

The flywheel assembly 40 is supported by upper and lower bearing assemblies inside the enclosure 30. Each bearing assembly comprises a bearing 50 mounted within a bearing block 58. Each bearing 50 comprises an inner race 52 that is affixed to and rotates with the flywheel shaft 44, an outer race 54 that is mounted inside the bearing block 58, and one or more ball bearings 56 disposed between the inner and outer races 52, 54. The bearing blocks 58 are secured to the interior of the enclosure 30. Seals (not shown) may advantageously be disposed on the top and bottom of the bearings 50 to contain lubricant in the bearings 50.

The motor 90 rotates the flywheel assembly 40 at a high rate of speed (e.g., 6000-9000 rpm). The motor 90 includes a rotor that connects to the flywheel shaft 44 and a stator that is secured to the enclosure 30 by any suitable mounting system. Although the motor 90 is advantageously mounted inside the enclosure 30, it is also possible to mount the motor 90 on the exterior of the enclosure 30. In one embodiment, the motor 90 operates on 230 Volt single phase AC power (or could be three-phase AC power, or AC or DC battery power, such as from a lithium ion battery pack) and is able to accelerate a flywheel assembly with a moment of inertia of about 32,273 lbm $in^2$ from rest to a rotational speed of 9000 rpm preferably in about 30 minutes or less for an average acceleration of about 5 rpm/s, and more preferably in about 20 minutes or less for an average acceleration of about 7.75 rpm/s, and even more preferably in about 10 minutes or less for an average acceleration of about 15 rpm/s (or 1.57 radians/$s^2$).

Figure 5:
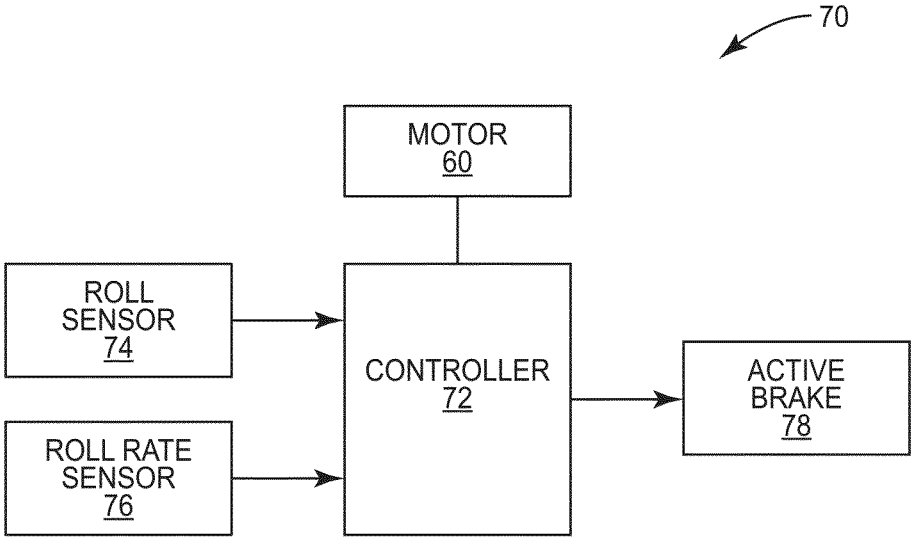
FIG. 5 shows a torque control system for the CMG.

The torque control system 70, shown in FIG. 5, controls the rate of precession of the flywheel assembly 40 about the gimbal axis G. The rolling motion of a boat 5 caused by wave action can be characterized by a roll angle and roll rate. The rolling motion causes the flywheel 42 to precess about the gimbal axis G. Sensors 74, 76 measure the roll angle and roll rate respectively, which are fed to a controller 72. The controller 72 generates control signals to control an active braking system or other torque applying device 78 that controls the rate of precession of the flywheel assembly 40. The flywheel assembly 40 generates a torque in opposition to the rolling motion. This torque is transferred through the gimbal 20 to the boat 5 to dampen the roll of the boat 5. An example of the active braking system 78 is described in U.S. Patent Application Publication No. US20200317308, which is incorporated herein by reference in its entirety.

When the flywheel assembly 40 rotates at high speed, the bearings 50 and motor 90 will generate a substantial amount of heat, which could lead to bearing and/or motor failure. Conventional air and liquid cooling techniques are not suitable for bearings 50 or other heat generating components contained within a vacuum or significantly below ambient pressure environment. The bearing cooling system 100, shown in FIGS. 7A and 7B, dissipates heat from both the inner and outer races 52, 54 of the bearings 50 supporting the flywheel assembly 40 during operation, and when the flywheel assembly 40 is being decelerated after power is removed from the motor 90.

Figure 6:
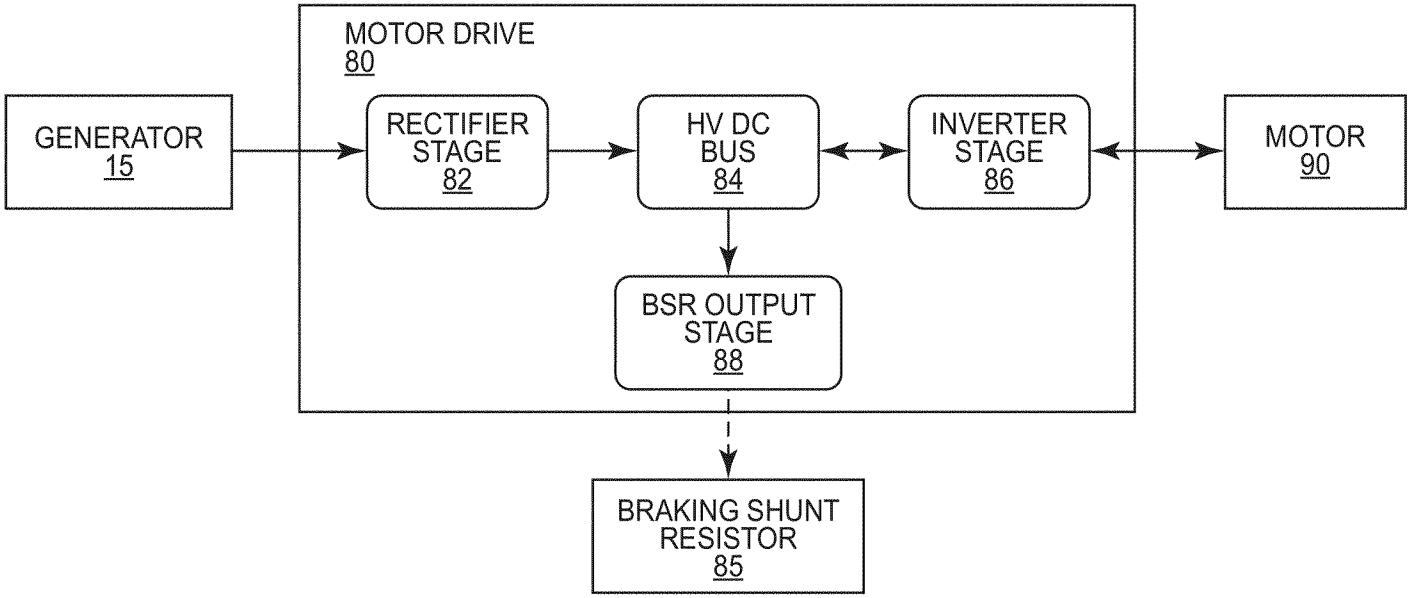
FIG. 6 shows a drive circuit for the electric motor.

The drive circuit 80 applies current to the motor 90 during normal operation to drive the motor 90. An exemplary drive circuit 80 is shown in FIG. 6. The drive circuit 80 includes a rectifier stage 82, a high voltage bus 84, inverter stage 86, and an output stage 88. In normal operating mode, an alternating current (AC) is supplied to the drive circuit 80 by a generator 15 located in the boat 5. When the rectifier stage 82 rectifies the alternating current and outputs a high voltage direct current to the inverter stage 86 via the high voltage circuit 84. The inverter stage 86 converts the high voltage DC into an alternating current suitable to drive the motor 90.

When power is removed from the drive circuit 80, the inertia of the flywheel assembly 40 will cause the motor 90 to continue rotating for a long period of time without braking. In one exemplary embodiment, the drive circuit 80 is configured to electrically brake the flywheel assembly hen the power is removed. The motor 90, in effect, becomes a generator and supplies power to the inverter stage 86. In power down mode, the inverter stage 86 functions as a rectifier and converts the alternating current generated by the motor 90 into a direct current. The high voltage bus directs the high voltage direct current to the output stage 88, which directs the output current to a shunt resistor 85 to electrically brake the flywheel assembly 40.

Although electrical braking is preferred, those skilled in the art will appreciate that the particular type of brake is not a material or essential element of the disclosure and that various types of mechanical brakes can be used to decelerate the flywheel after the power is removed. Braking can also be achieved by increasing drag on the flywheel assembly in a power down mode.

The inertia of the flywheel assembly 40 typically requires many hours to decelerate the flywheel to a full stop after power is turned off. While the flywheel is slowing down, it continues to make a whining noise, which can be disruptive to the enjoyment of the occupants after the boat has arrived at its destination on the water or returned to the docks following a day of boating. Electrical braking as herein described can bring the flywheel to a full stop in a much shorter period of time. The flywheel assembly 40 is preferably brought to a full stop in about 2.5 hours or less, more preferably in about 2 hours or less, and most preferably in about 1 hour or less.

When decelerating the flywheel assembly 40, it is important to maintain the temperature differential between the inner race 52 and outer race 54 of the bearings 50 below a threshold, which can be problematic depending on the bearing cooling arrangement. Current CMGs on the market use interleaved fins to dissipate heat from the inner races 52 of the bearings 50 and solid conduction to cool the outer races 54 of the bearings 50. The interleaved fins rely on gaseous conduction and convection to transfer heat from a rotating set of fins in contact with the inner race 52 to a stationary set of fins in contact with the enclosure 30. The relative motion of the interleaved fins causes fluid flow of the gas in the gaps between the fins. At low relative speeds, the fluid flow of the gas is laminar while at higher speeds the fluid flow becomes more turbulent. A turbulent flow increases the efficiency of heat transfer between the fins. Because the interleaved fins are operating in a below ambient environment, there is relatively little gas to effect heat transfer. Therefore, it is necessary to maintain a high relative speed in order to dissipate heat from the inner race 52. When the flywheel assembly 40 is slowed down or stopped, the interleaved fins will lose the ability to dissipate heat from the inner race 52 while heat continues to be dissipated from the outer bearings creating a temperature differential across the inner and outer races 54. If this temperature differential is too large, the different rates of expansion and contraction of the bearing materials will create stresses that distort the bearings 50 and have a detrimental impact on the life of the bearings. As a consequence, it is not possible to rapidly stop the flywheel assembly without causing damage to the bearings 50.

In embodiments of the present disclosure, the bearing cooling system 100 is designed to maintain the temperature differential between the inner race 52 and outer race 54 of the bearings 50 below a predetermined threshold even while the flywheel assembly 40 is rapidly decelerated. The threshold will depend on the bearing design and materials and needs to be determined empirically or from test data available from the bearing manufacturer. Various embodiments of the bearing cooling system 100 are described to maintain the temperature differential below the threshold.

Figure 7A:
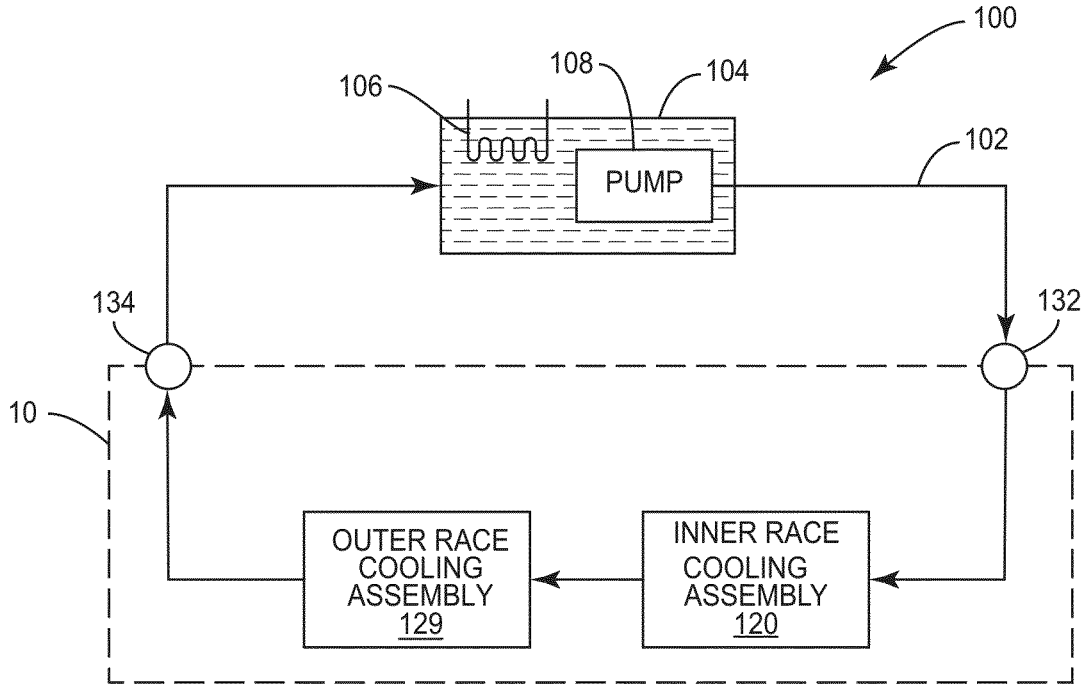
FIGS. 7A and 7B show simplified schematics of a bearing cooling circuit for cooling the bearings.
Figure 7B:
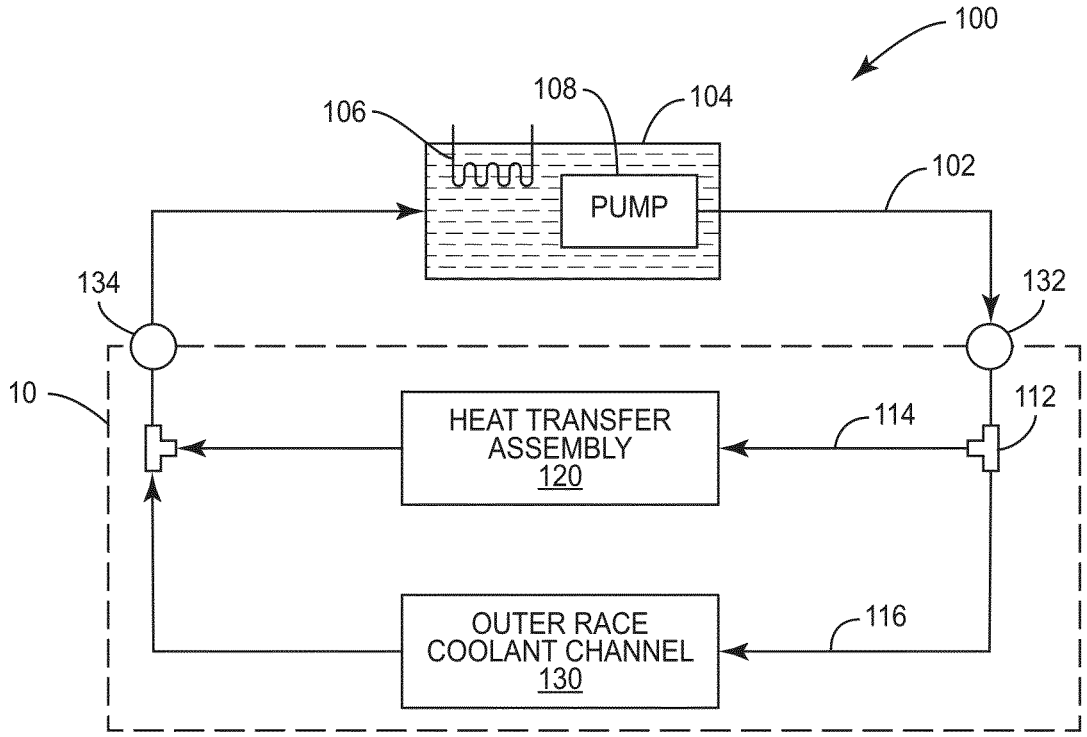

FIGS. 7A and 7B are schematic diagrams showing two embodiments of the bearing cooling system 100. It should be noted that there are separate bearing cooling systems 100 for the upper and lower bearings 50 respectively. The following discussion describes one of the bearing cooling systems 100 with the understanding that the bearing cooling systems 100 for the upper and lower bearings 50 are essentially the same.

The bearing cooling system 100 generally comprises a closed fluid circuit 102 through which a liquid coolant is circulated. The liquid coolant may be any suitable liquid, with a liquid such as glycol and/or glycol mixtures being particular examples. The fluid circuit includes a fluid reservoir 104 that contains the liquid coolant. The fluid reservoir 104 includes a heat exchanger 106 to cool the liquid coolant resident in the fluid reservoir 104. A pump 108 circulates the liquid coolant through the fluid circuit 102. The fluid reservoir 104, heat exchanger 106 and pump 108 may be shared by the bearing cooling systems 100 for the upper and lower bearings 50.

The fluid circuit 102 directs the liquid coolant through an inner race cooling assembly 120 that dissipates heat from the inner races 54 of the bearings 50 and through an outer race cooling assembly 129 formed in part by the bearing block 58 to dissipate heat from the outer race 54 of the bearing 50. The inner race cooling assembly 120 and outer race cooling assembly 129 may be in series as shown in FIG. 7A or in parallel as shown in FIG. 7B. In both designs, the coolant enters enclosure 30 through an inlet port 132 and exits enclosure 30 through an outlet port 134. Alternatively, separate cooling circuits can be provided for the inner race 52 and outer race 54 respectively.

In the series arrangement shown in FIG. 7A, the coolant flow circulates first through the inner race cooling assembly 120 and then through the coolant passage. After leaving the fluid reservoir 104, the liquid coolant enters enclosure 30 through inlet port 132 and flows through inner race cooling assembly 120 where it adsorbs and carries away heat generated by the inner races 52 of the bearings 50, as described more fully below. After exiting the inner race cooling assembly 120, the liquid coolant flow passes through the outer race cooling assembly 129 where the coolant flow adsorbs and carries away heat generated by the outer races 54 of the bearings 50. After exiting the outer race cooling assembly 129, the liquid coolant flow exits enclosure 30 through outlet port 134 and returns to the fluid reservoir 104, where it is cooled by the heat exchanger 106 prior to being recirculated.

In the parallel arrangement shown in FIG. 7B, the coolant flow passes through a splitter 112 that divides the liquid coolant flow between a first branch 114 and a second branch 116. Liquid coolant flowing through branch 114 passes through an inner race cooling assembly 120 where it adsorbs and carries away heat generated by the inner races 52 of the bearings 50. Liquid coolant flowing through branch 116 passes through the outer race cooling assembly 129 where it adsorbs and carries away heat generated by the outer races 54 of the bearings 50, as described more fully below. The heated coolant in both branches 114, 116 flows back into the fluid reservoir 104 where it is cooled by the heat exchanger 106.

The bearing cooling system 100 as herein described provides active cooling for both the inner races 52 and outer races 54 of the bearings 50. In other embodiments, passive cooling methods may be employed for one or both of the inner race and/or outer race cooling. The inner race cooling assembly 120 and outer race cooling assembly 129 deliver liquid coolant in close proximity to the inner races 52 and outer races 54 respectively to more effectively cool the bearings 50 and provide greater control over the temperature differential between the inner races 52 and outer races 54 of the bearings 50. In some embodiments, the amount of liquid coolant flow can be designed to provide the desired heat dissipation effect. Generally, the inner races 52 of the bearings 50 will heat more than the outer races 54. Both the series arrangement and parallel arrangement provide a differential heat transfer capacity for the inner races 52 and outer races 54 respectively. In the series arrangement, the temperature of the liquid coolant when it flows through the inner race cooling assembly 120 will be lower than when the liquid coolant flows through the outer race cooling assembly 129 and therefore have more heat transfer capacity. In this case, the initial temperature of the liquid coolant is chosen such that it provides sufficient cooling for the outer races 54 of the bearings 50 after absorbing heat from the inner races 52. In the parallel arrangement, the amount of liquid coolant flow through the inner race cooling assembly 120 and outer race cooling assembly 129 can be varied to provide more heat dissipation capacity to the inner race cooling assembly 120, i.e., by providing a higher flow rate through branch 114 than through branch 116.

Figure 4:
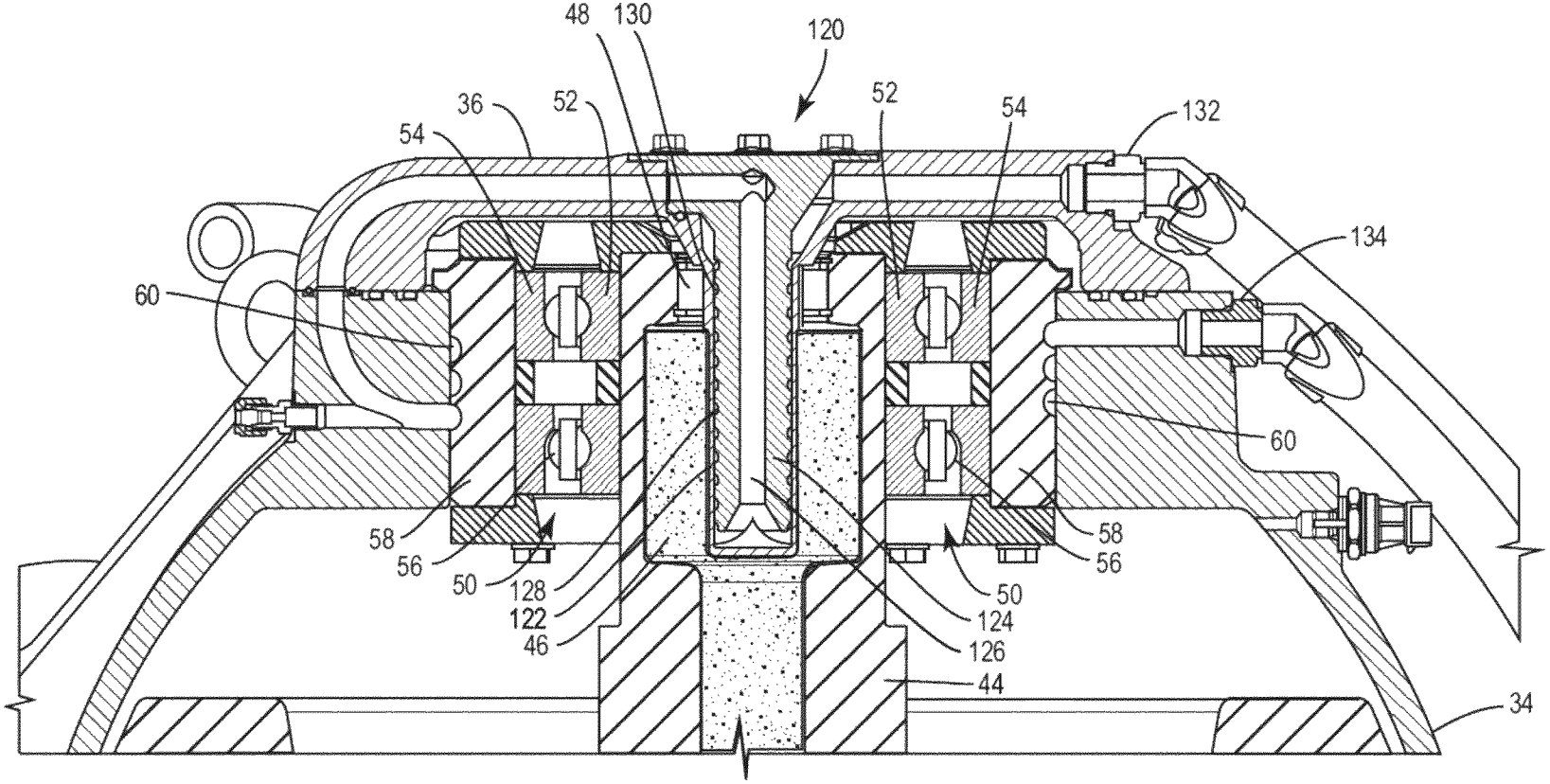
FIG. 4 shows a partial section view of the CMG showing elements of the bearing cooling system.

FIG. 4 illustrates a inner race cooling assembly 120 according to one exemplary embodiment for dissipating heat from the inner races 52 of the bearings 50. As previously noted, there is a separate inner race cooling assembly 120 for the upper and lower bearings 50, which are essentially the same. FIG. 4 illustrates the heat transfer assembly for the upper bearing 50.

In the case of the upper bearing 50, the inner race cooling assembly 120 extends downward from the end cap 36 into a cavity 46 formed in the end of the flywheel shaft 44. Similarly, for the lower bearing 50, the inner race cooling assembly 120 extends upward from the end cap 36 into a cavity 46 formed in the lower end of the flywheel shaft 44. The inner race cooling assembly 120 does not directly engage the side wall or bottom of the cavity 46, but rather is spaced from the side wall and bottom walls of the cavity 46 in close proximity to the inner races 52 of the bearings 50.

In some embodiments, a heat transfer medium is contained in the gap between the inner race cooling assembly 120 and the side walls of the cavity 46. As one example, the heat transfer medium comprises a low vapor pressure fluid that is suitable for the low pressure environment in the enclosure 30. A low vapor pressure fluid is a liquid, such as oil, that has a relatively low boiling point compared to water and is suitable for employment in a vacuum environment. For example, aerospace lubricants, such as perfluoropolyether (PFPE) lubricants, designed for vacuum environments can be used as the heat transfer medium. The low vapor pressure fluid enables transfer of heat from the flywheel shaft 44 to the inner race cooling assembly 120 by liquid conduction and liquid convection. A seal 48 extends around the inner race cooling assembly 120 and effectively seals the cavity 46 such that the heat transfer medium is maintained within the cavity 46. In some embodiments, seal 48 is fixed to the inner race cooling assembly 120, which means that the flywheel shaft 44 rotates around the seal 48. In other embodiments, seal 48 is fixed to the flywheel shaft 44, so that seal 48 rotates with the flywheel shaft 44.

In normal operating mode, heat is transferred from the inner races 52 of the bearings 50 to the flywheel shaft 44. The heat transfer medium conducts heat from the flywheel shaft 44 to the inner race cooling assembly 120 by liquid conduction. The liquid coolant circulating through the inner race cooling assembly 120 absorbs and carries away heat generated by the inner races 52 of the bearings 50.

The inner race cooling assembly 120 includes two main parts: a sleeve 122 that is integrally formed with the end cap 36 and a heat transfer shaft 124. The end of the sleeve 122 that inserts into the cavity 46 is closed and the end connecting to the end cap 36 is open and accessible from the exterior of the enclosure 30. The heat transfer shaft 124 is inserted into the sleeve 122 from the exterior of the enclosure 30. The end of the heat transfer shaft 124 stops short of the closed end of the sleeve 122. The heat transfer shaft 124 is secured by fasteners to the end cap 136 so that the heat transfer member 102 is effectively suspended in the cavity 46 formed in the flywheel shaft 44.

The heat transfer shaft 124 includes a central bore 126 that is open at the distal end adjacent the closed end of the sleeve 122. One or more grooves 128 are formed in the outer surface of the heat transfer shaft. The outer diameter of the heat transfer shaft 124 closely matches the inner diameter of the sleeve 122 so that a fluid channel 130 is jointly defined by the sleeve 122 and the groove(s) 128.

The central bore 126 is in fluid communication with inlet port 132 for liquid coolant and the groves 128 are in fluid communication with outlet port 134. Inlet port 132 and outlet port 134 can be formed in either housing section 34 or end cap 36 of the enclosure 30. Liquid coolant enters the central bore 126 and exits through the opening in the distal end of the heat transfer shaft 124. Liquid coolant exiting the central bore 126 of the heat transfer shaft 124 enters the fluid channels 130 defined by the grooves 128 grooves and flows around the heat transfer shaft 124 towards the outlet port. In one embodiment, the groove 128 comprises one or more helical or spiral grooves that encircle the heat transfer shaft 124. As the liquid coolant flows around the heat transfer shaft 124, heat dissipated from the inner races 52 of the bearings 50 is absorbed and carried off by the coolant flow. In the arrangement of the fluid circuit 102, the coolant flows from the inner race cooling assembly 120 and through the outer race cooling assembly 129 before arriving at outlet port 134. In the parallel arrangement of the fluid circuit 102, the coolant flows from the inner race cooling assembly 120 to outlet port 134.

Those skilled in the art will appreciate that the details of the heat transfer assembly are not a material aspect of the disclosure and that other methods can be employed to remove heat from the inner races of the bearings so long as there is sufficient heat dissipation capacity to maintain the heat differential below the threshold. Other useful methods for removing heat from the inner race include use of interleaved fins, oil cooling, air cooling, or passive cooling through conduction. One example of interleaved fins for cooling the inner race is described in U.S. Pat. No. 7,546,782. One example of oil cooling is described in U.S. Pat. Nos. 10,794,699 and 10,989,534. Other cooling methods are described in U.S. Pat. No. 11,427, 289.

The outer race cooling assembly 129 is also shown in FIG. 4. The outer race cooling assembly 129 comprises a coolant channel 130 formed between the bearing block 58 and enclosure 30 and is in fluid communication with an outlet port 134 formed in the enclosure 30. For example, the bearing block 58 may include one or more grooves 60 on its outer surface. Such groove(s) 60 are conceptually closed off to form the coolant channel 130 by the inner wall of enclosure 30 facing the bearing block 58. Alternatively, or in addition, the enclosure 30 may include one or more grooves (not shown) on an inner surface that faces the bearing block 58. Such groove(s) are conceptually closed off to form the coolant channel 130 by the outer surface of the bearing block 58 facing the enclosure 30. In still other embodiments, the grooves 60 can be replaced by coolant passages formed in the bearing block 58 near the inner surface. The coolant channel 130 preferably winds around the flywheel axis F in a helical or spiral fashion. Alternatively, multiple coolant channels 130 may be provided that run parallel to the flywheel axis F along an outer surface of the bearing block 58.

The heat flow for dissipating heat from the outer race 54 is from the outer race 54 to the bearing block 58 by solid conduction, then by conduction and convection to the liquid coolant in the fluid channel 130, which absorbs and carries the heat away. Additionally, a portion of the heat is transferred by solid conduction from the outer race 54 to the bearing block 58, then by solid conduction through the bearing block 58 to the enclosure 30, which acts as a heat sink.

Those skilled in the art will appreciate that the details the particular method for cooling the outer bearing is not a material aspect of the disclosure and that other methods can be employed to remove heat from the outer races 54 of the bearings. For example, heat can be dissipated by oil cooling, air cooling, and passive methods, such as solid conduction to the enclosure so long as there is sufficient heat dissipation capacity to maintain the heat differential below the threshold.

The bearing cooling systems 100 as herein described allows much greater heat dissipation compared to current technology, which enables use of a larger motor 90, and advantageously lower operating temperature even with the larger motor 90. The larger motor 90 and lower operating temperature enable more rapid acceleration and deceleration of the flywheel assembly 40.

In use, the CMG 10 is normally locked while the flywheel assembly 40 is being accelerated to prevent precession of the flywheel 42 until a predetermined rotational speed is achieved. The CMG 10 can be locked to prevent rotation of the enclosure 30 by the active braking system 78. When the CMG 10 is unlocked, precession of the flywheel 42 will place side loads on the bearings 50. The bearing friction from the side loading of the bearings 50 generates heat, which is dissipated by the bearing cooling system 100.

After a day of boating, power to the CMG 10 can be removed, i.e., turned off. In the power down mode, the CMG 10 is typically locked. When the power is turned off, the motor 90, in effect, becomes a generator and the drive circuit 80 directs electrical current generated by the motor 90 to a shunt resistor 85 to rapidly decelerate the motor 90. Thus, the drive circuit 80 functions as an electrical brake for the CMG 10. While the flywheel assembly 40 is slowing down, the bearing cooling system 100 remains effective to cool the inner races 52 and outer races 54 of the bearings 50 so that the temperature differential between the inner races 52 and outer races 54 of the bearings 50 remain below a predetermined threshold. Maintaining the temperature differential below the threshold reduces or eliminates the potential for damage to the bearings 50 caused by the uneven cooling of the inner races 52 and outer races 54 of the bearings 50. Thus, the bearing cooling system 100 enables rapid deceleration of the flywheel assembly from a normal operating speed to a full stop in a relatively short period of time.

Table 1 below shows the time to decelerate the flywheel assembly to a full stop after power is removed for different CMGs 10 where the rate of deceleration for the smaller CMGs 10 is 1 rpm/s and the rate of declaration for the larger CMGs 10 is ⅔ rpm/sec.

TABLE 1

Deceleration Time-Example 1

| | Time to full stop (min) | Weight (lbs) | Moment of Inertia (lbm ft$^2$) | Speed RPM) | Deceleration (RPM/s) |
|---|---|---|---|---|---|
| Model 1 | 150 | 125 | <40 | 9000 | 1 |
| Model 2 | 150 | 210 | 40-60 | 9000 | 1 |
| Model 3 | 150 | 325 | 60-90 | 9000 | 1 |
| Model 4 | 150 | 425 | 90-200 | 9000 | 1 |
| Model 5 | 150 | 600 | 200-500 | 9000 | 1 |
| Model 6 | 150 | 1000 | 500-800 | 6000 | 2/3 |

TABLE 1-continued

Deceleration Time-Example 1

| | Time to full stop (min) | Weight (lbs) | Moment of Inertia (lbm ft$^2$) | Speed RPM) | Deceleration (RPM/s) |
|---|---|---|---|---|---|
| Model 7 | 150 | 1500 | 800-1200 | 6000 | 2/3 |
| Model 8 | 150 | 1900 | >1200 | 6000 | 2/3 |

Table 2 below shows the time to decelerate the flywheel assembly to a full stop after power is removed for different CMGs 10 where the rate of deceleration for the smaller CMGs 10 is 1.25 rpm/s and the rate of declaration for the larger CMGs 10 is 8.33 rpm/sec.

TABLE 2

Deceleration Time-Example 1

| | Time to full stop (min) | Weight (lbs) | Moment of Inertia (lbm ft$^2$) | Speed RPM) | Deceleration (RPM/s) |
|---|---|---|---|---|---|
| Model 1 | 120 | 125 | <40 | 9000 | 1.25 |
| Model 2 | 120 | 210 | 40-60 | 9000 | 1.25 |
| Model 3 | 120 | 325 | 60-90 | 9000 | 1.25 |
| Model 4 | 120 | 425 | 90-200 | 9000 | 1.25 |
| Model 5 | 120 | 600 | 200-500 | 9000 | 1.25 |
| Model 6 | 120 | 1000 | 500-800 | 6000 | .833 |
| Model 7 | 120 | 1500 | 800-1200 | 6000 | .833 |
| Model 8 | 120 | 1900 | >1200 | 6000 | .833 |

Table 3 below shows the time to decelerate the flywheel assembly to a full stop after power is removed for different CMGs 10 where the rate of deceleration for the smaller CMGs 10 is 1.67 rpm/s and the rate of declaration for the larger CMGs 10 is 1.11 rpm/sec.

TABLE 3

Deceleration Time-Example 1

| | Time to full stop (min) | Weight (lbs) | Moment of Inertia (lbm ft$^2$) | Speed RPM) | Deceleration (RPM/s) |
|---|---|---|---|---|---|
| Model 1 | 90 | 125 | <40 | 9000 | 1.67 |
| Model 2 | 90 | 210 | 40-60 | 9000 | 1.67 |
| Model 3 | 90 | 325 | 60-90 | 9000 | 1.67 |
| Model 4 | 90 | 425 | 90-200 | 9000 | 1.67 |
| Model 5 | 90 | 600 | 200-500 | 9000 | 1.67 |
| Model 6 | 90 | 1000 | 500-800 | 6000 | 1.11 |
| Model 7 | 90 | 1500 | 800-1200 | 6000 | 1.11 |
| Model 8 | 90 | 1900 | >1200 | 6000 | 1.11 |

Table 4 below shows the time to decelerate the flywheel assembly to a full stop after power is removed for different CMGs 10 where the rate of deceleration for the smaller CMGs 10 is 2.5 rpm/s and the rate of declaration for the larger CMGs 10 is 1.67 rpm/sec.

TABLE 4

Deceleration Time-Example 1

| | Time to full stop (min) | Weight (lbs) | Moment of Inertia (lbm ft$^2$) | Speed RPM) | Deceleration (RPM/s) |
|---|---|---|---|---|---|
| Model 1 | 60 | 125 | <40 | 9000 | 2.5 |
| Model 2 | 60 | 210 | 40-60 | 9000 | 2.5 |
| Model 3 | 60 | 325 | 60-90 | 9000 | 2.5 |
| Model 4 | 60 | 425 | 90-200 | 9000 | 2.5 |
| Model 5 | 60 | 600 | 200-500 | 9000 | 2.5 |

TABLE 4-continued

| Deceleration Time-Example 1 | | | | | |
|---|---|---|---|---|---|
| | Time to full stop (min) | Weight (lbs) | Moment of Inertia (lbm ft$^2$) | Speed RPM) | Deceleration (RPM/s) |
| Model 6 | 60 | 1000 | 500-800 | 6000 | 1.67 |
| Model 7 | 60 | 1500 | 800-1200 | 6000 | 1.67 |
| Model 8 | 60 | 1900 | >1200 | 6000 | 1.67 |

Table 5 below shows the time to decelerate the flywheel assembly to a full stop after power is removed for different CMGs 10 where the rate of deceleration for the smaller CMGs 10 is 5 rpm/s and the rate of declaration for the larger CMGs 10 is 3.33 rpm/sec.

TABLE 5

| Deceleration Time-Example 1 | | | | | |
|---|---|---|---|---|---|
| | Time to full stop (min) | Weight (lbs) | Moment of Inertia (lbm ft$^2$) | Speed RPM) | Deceleration (RPM/s) |
| Model 1 | 30 | 125 | <40 | 9000 | 5 |
| Model 2 | 30 | 210 | 40-60 | 9000 | 5 |
| Model 3 | 30 | 325 | 60-90 | 9000 | 5 |
| Model 4 | 30 | 425 | 90-200 | 9000 | 5 |
| Model 5 | 30 | 600 | 200-500 | 9000 | 5 |
| Model 6 | 30 | 1000 | 500-800 | 6000 | 3.33 |
| Model 7 | 30 | 1500 | 800-1200 | 6000 | 3.33 |
| Model 8 | 30 | 1900 | >1200 | 6000 | 3.33 |

The bearing cooling systems 100 as described herein enable more efficient heat transfer, which enables a far greater heat transfer capacity and enables the use of electrical braking to rapidly decelerate the flywheel after a day of boating. In one aspect, the bearing cooling system 100 is able to maintain the temperature differential between the inner race 52 and outer race 54 of the bearings 50 below a predetermined threshold even while the flywheel assembly 40 is rapidly decelerated so that damage to the bearings 50 is avoided. In some embodiments, the flywheel assembly may be brought to a full stop in 30 minutes or less from a speed of 9000 rpm for smaller CMGs 10 and 6000 rpm for larger CMGs 10.

The present disclosure may, of course, be carried out in other ways than those specifically set forth herein without departing from essential characteristics of the disclosure. The present embodiments are to be considered in all respects as illustrative and not restrictive, and all changes coming within the meaning and equivalency range of the appended claims are intended to be embraced therein.

What is claimed is:

1. A gyroscopic roll stabilizer for a boat, the gyroscopic stabilizer comprising:

an enclosure mounted to a gimbal for rotation about a gimbal axis and configured to maintain a below-ambient pressure;

a flywheel assembly including a flywheel and flywheel shaft rotatably mounted in the enclosure;

at least one bearing supporting the flywheel assembly in the enclosure, the bearing including an inner race;

a motor operative to rotate the flywheel assembly;

a brake configured to decelerate the flywheel assembly from a normal operating speed to a stop in 2.5 hours or less after power to the motor is turned off; and a bearing cooling system for dissipating heat from both the inner and outer races of the bearing while the flywheel assembly is decelerating, the bearing cooling system being configured to maintain a temperature differential between the inner and outer races below a threshold to prevent damage to the bearing.

2. The gyroscopic roll stabilizer of claim 1, wherein the bearing cooling system includes a heat transfer assembly that extends into a cavity formed in an end of the flywheel shaft, the heat transfer assembly being configured to dissipate heat from the inner race of the bearing.

3. The gyroscopic roll stabilizer of claim 2, further comprising a fluid pathway through the heat transfer assembly for circulating a liquid coolant through the heat transfer assembly.

4. The gyroscopic roll stabilizer of claim 3, wherein the heat transfer assembly comprises:

a sleeve;

an heat transfer shaft disposed within the sleeve;

a central bore in the heat transfer shaft forming a first part of the fluid pathway; and one or more grooves in an outer surface of the heat transfer shaft forming a second part of the fluid pathway.

5. The gyroscopic roll stabilizer of claim 4, wherein the grooves wind around the axis of the flywheel assembly.

6. The gyroscopic roll stabilizer of claim 1, wherein the bearing cooling system comprises a bearing block supporting the bearing, and an coolant channel formed at least in part by the bearing block.

7. The gyroscopic roll stabilizer of claim 1, wherein the brake is configured to decelerate a flywheel assembly with a moment of inertia of not more than 200 lbm·ft$^2$· at a rate of at least 1 rpm/sec.

8. The gyroscopic roll stabilizer of claim 7, wherein the brake is configured to decelerate a flywheel assembly with a moment of inertia of not more than 200 lbm·ft$^2$· at a rate of at least 2.5 rpm/sec.

9. The gyroscopic roll stabilizer of claim 7, wherein the brake is configured to decelerate a flywheel assembly with a moment of inertia of not more than 200 lbm·ft$^2$· at a rate of at least 5 rpm/sec.

10. The gyroscopic roll stabilizer of claim 1, wherein the brake is configured to decelerate a flywheel assembly with a moment of inertia of 200 lbm·ft$^2$· or more at a rate of at least 0.67 rpm/sec.

11. The gyroscopic roll stabilizer of claim 7, wherein the brake is configured to decelerate a flywheel assembly with a moment of inertia of 200 lbm·ft$^2$· or more at a rate of at least 1 rpm/sec.

12. The gyroscopic roll stabilizer of claim 7, wherein the brake is configured to decelerate a flywheel assembly with a moment of inertia of 200 lbm·ft$^2$· or more at a rate of at least 3 rpm/sec.

13. The gyroscopic roll stabilizer of claim 1, wherein the brake is an electrical brake.

14. A method of operating a controlled moment gyroscope configured for roll stabilization of a boat, the method comprising:

maintaining a below ambient pressure within a vacuum enclosure surrounding a flywheel assembly, the flywheel assembly including a flywheel shaft;

removing power from an electric motor driving the flywheel assembly;

braking the flywheel assembly after the power is removed from the motor to decelerate the flywheel assembly from a normal operating speed to a stop in 2.5 hours or less; and while the flywheel assembly is decelerating, dissipating heat from the inner and outer races of a bearing supporting the flywheel assembly by:

transferring heat generated by the inner race of the bearing to a cooling fluid circulating within a bearing cooling circuit via a first heat transfer path; and transferring heat generated by the outer race of the bearing to the cooling fluid circulating within the bearing cooling circuit via a second heat transfer path.

15. The method of claim 14, wherein braking the flywheel assembly after the power is removed from the motor comprises electrically braking the flywheel assembly.

16. A gyroscopic roll stabilizer for a boat, the gyroscopic stabilizer comprising:

an enclosure mounted to a gimbal for rotation about a gimbal axis and configured to maintain a below-ambient pressure;

a flywheel assembly including a flywheel and flywheel shaft rotatably mounted in the enclosure;

at least one bearing supporting the flywheel assembly in the enclosure, the bearing including an inner race and an outer race;

a motor operative to rotate the flywheel assembly;

a brake configured to decelerate the flywheel assembly from a normal operating speed to a stop in 2.5 hours or less after power to the motor is turned off;

a bearing cooling circuit for dissipating heat from both the inner and outer races of the bearing while the flywheel assembly is decelerating;

a first heat flow path to transfer heat from the inner race to the cooling fluid in the bearing cooling circuit; and a second heat flow path to transfer heat from the outer race to the cooling fluid in the bearing cooling circuit.

17. The gyroscopic roll stabilizer of claim 16, further comprising a heat transfer shaft rotationally fixed relative to the flywheel axis and extending into a bore in the flywheel shaft, the heat transfer shaft being in the first heat transfer path.

18. The gyroscopic roll stabilizer of claim 17, wherein the bearing cooling circuit is routed through the heat transfer shaft to enable transfer of heat from the inner race to the cooling fluid flowing through the heat transfer shaft via the first heat flow path.

19. The gyroscopic roll stabilizer of claim 18, wherein the bearing cooling circuit includes a fluid channel formed in the enclosure, wherein the fluid channel is arranged to enable heat transfer from the outer race to the cooling fluid flowing through the fluid channel in the enclosure via the second heat flow path.

20. The gyroscopic roll stabilizer of claim 19, wherein the second heat flow path is through an intervening component of the gyroscopic roll stabilizer between the outer race and fluid channel.

21. The gyroscopic roll stabilizer of claim 18, wherein the heat transfer shaft and fluid channel are connected in series in the bearing cooling circuit.

22. The gyroscopic roll stabilizer of claim 18, wherein the heat transfer shaft and fluid channel are connected in parallel in the bearing cooling circuit.

23. The gyroscopic roll stabilizer of claim 16, wherein the bearing cooling circuit comprises:

a single fluid pump to recirculate the liquid coolant through the bearing cooling circuit; and a single heat exchanger external to the enclosure to remove heat from the cooling fluid.

* * * * *